US007189099B2

(12) United States Patent
Whyne et al.

(10) Patent No.: US 7,189,099 B2
(45) Date of Patent: Mar. 13, 2007

(54) ELECTRICAL CONNECTOR HAVING A LATCH GUARD

(75) Inventors: Richard Nicholas Whyne, Camp Hill, PA (US); David Allison Trout, Lancaster, PA (US); Jeffrey Byron McClinton, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/194,335

(22) Filed: Aug. 1, 2005

(65) Prior Publication Data

US 2007/0026721 A1 Feb. 1, 2007

(51) Int. Cl.
*H01R 13/627* (2006.01)

(52) U.S. Cl. ..... 439/358

(58) Field of Classification Search ..... 439/358, 439/352

See application file for complete search history.

(56) References Cited

U.S. PATENT DOCUMENTS 4,941,839 A * 7/1990 Nagasaka et al. ..... 439/358
4,944,693 A 7/1990 Puerner
4,986,766 A 1/1991 Leonard et al.
5,382,177 A 1/1995 Hutchinson, Jr. et al.
5,692,681 A 12/1997 Steinhauser et al.
5,873,747 A 2/1999 Tsuji
6,945,825 B2 * 9/2005 Aramoto et al. ..... 439/358

* cited by examiner

*Primary Examiner*—Briggitte Hammond

(57) ABSTRACT

An electrical connector for mating with a complementary connector receptacle is provided and includes a housing configured and adapted for selective matable connection with a corresponding complementary connector receptacle; a pair of latch arms provided on opposite sides of the housing; and a pair of latch guards extending from the sides of the housing and overlying at least a portion of a respective latch arm. Each latch arm includes a hinge joint spaced a selected distance rearwardly from a forward end thereof for joining the latch arm to a respective side of the housing. Accordingly, as a latch arm is twisted about the hinge joint, at least a portion of the latch arm abuts against the respective latch guard and additional twisting of the latch arm about the hinge joint is prevented.

20 Claims, 6 Drawing Sheets

ELECTRICAL CONNECTOR HAVING A LATCH GUARD

BACKGROUND

1. Technical Field

The present disclosure relates to electrical connectors and, more particularly, to electrical connector housings which are configured and adapted to reduce breakage of latch members thereof.

2. Discussion of Related Art

Housings for certain electrical connectors are molded from dielectric plastic material and are intended to be secured to mating or complementary connector receptacles when the connector and receptacle has been moved together in a mated condition. In so doing the respective arrays of electrical contacts are mated to complete electrical connections therebetween. In some of these connectors or receptacles, hardware is fastened to or structures are provided on the respective housings to ensure proper and secure mating of the connector with the receptacle when in the mated condition. Desirably, each respective housing includes an integral latching element or the like. For example, integrally molded latch arms may be disposed along opposed sides of the housing of one of the connector and receptacle and may extend forwardly to latchingly engage with corresponding/complementary latching surfaces of the housing of the other of the connector and receptacle, when the connector and receptacle are moved together into a mated condition.

Exemplary latch arms used for securing connector and receptacles together are disclosed in U.S. Pat. No. 4,867,700, the entire content of which is incorporated herein by reference, and assigned to assignee hereof. The latch arms include rearward portions which are deflectable to unlatch the latch arms when it is desired to separate and unmate the connector and the receptacle, in which case the latch arms can be said to be hingedly joined to the housing.

Such latch arms are subjected to stress and torque during mating and unmating of the connector and receptacle. Accordingly, the hinge joint must be rugged and durable to withstand many cycles of mating and unmating, especially taking into consideration that the hinge joint is molded of plastic material which can commonly lose strength over time when worked and subjected to temperature cycling as well.

A need exists for an electrical connector or connector receptacle which is configured and adapted to reduce the degree of torque transmitted to the latch arms or the like.

A need further exists for an electrical connector or connector receptacle which is configured and adapted to reduce the degree of motion of the latch arm and/or reduces the degree of flexure in the hinge connecting the latch arm to the connector or receptacle.

SUMMARY

The present disclosure relates to electrical connector housings which are configured and adapted to reduce breakage of latch arms thereof.

According to an aspect of the present disclosure, an electrical connector for mating with a complementary connector receptacle is provided. The electrical connector includes a housing configured and adapted for selective matable connection with a corresponding complementary connector receptacle; a pair of latch arms provided on opposite sides of the housing; and a pair of latch guards extending from the sides of the housing and overlying at least a portion of a respective latch arm. Each latch arm includes latching projections at a forward end of the latch arm which are configured and adapted for selective engagement with corresponding latching means provided on the connector receptacle; and a hinge joint spaced a selected distance rearwardly from the forward end thereof for joining the latch arm to a respective side of the housing. Accordingly, as a latch arm is twisted about the hinge joint, at least a portion of the latch arm abuts against the respective latch guard and additional twisting of the latch arm about the hinge joint is prevented.

Each latch guard may extend distally and proximally of the hinge joint.

Each latch arm may include a first stop feature extending therefrom at a location between the latching projection and the hinge joint. The first stop feature desirably extends towards the housing. Accordingly, upon twisting of the latch arm about the hinge joint, the first stop feature is engagable with the respective latch guard to stop twisting of the latch arm.

Each latch arm desirably includes a rearward portion extending rearwardly from the respective hinge joint. Each latch arm may include a second stop feature extending therefrom at a location rearward of the hinge joint. The second stop feature desirably extends towards the housing.

In use, upon twisting of the latch arm about the hinge joint, the second stop feature is engageable with the respective latch guard to stop twisting of the latch arm.

Each latch arm is desirably deflectable about the hinge joint. Accordingly, flexure of the forward end of the latch arm toward the housing is stopped by the first stop feature. Additionally, flexure of the rearward end of the latch arm toward the housing is stopped by the second stop feature.

It is envisioned that the housing and the latch arms are fabricated from a dielectric material.

According to another aspect of the present disclosure, wherein an electrical connector for selective mating with a complementary connector receptacle is provided, and wherein the electrical connector includes a housing, a pair of latch arms hingedly connected to and extending from opposite sides of the housing, the improvement includes a pair of latch guards extending from opposite sides of the housing. Each latch guard overlies at least a portion of a respective latch arm. The latch guards stop twisting of the latch arms about the hinge joint in a direction transverse to a longitudinal axis of the latch arms.

Each latch arm desirably includes a latching projection at a forward end thereof for selectively engaging a corresponding latching means provided on the connector receptacle.

The hinge joint is desirably spaced a selected distance rearwardly from the forward end of the latch arm. Desirably, each latch guard extends distally and proximally of the hinge joint.

In use, the latch guards stop twisting of the latch arms about an axis transverse to a pivot axis of the hinge joint.

Each latch arm may include a first stop feature extending therefrom at a location between the latching projection and the hinge joint. In use, upon twisting of the latch arm about the hinge joint, the first stop feature is engagable with the respective latch guard to stop twisting of the latch arm. Each latch arm may include a rearward portion extending rearwardly from the respective hinge joint. Each latch arm may further include a second stop feature extending therefrom at a location rearward of the hinge joint. As such, upon twisting of the latch arm about the hinge joint, the second stop feature is engageable with the respective latch guard to stop twisting of the latch arm.

For a better understanding of the present invention and to show how it may be carried into effect, reference will now be made by way of example to the accompanying drawings.

DETAILED DESCRIPTION OF THE DRAWINGS

DETAILED DESCRIPTION OF EMBODIMENTS

Figure 1:
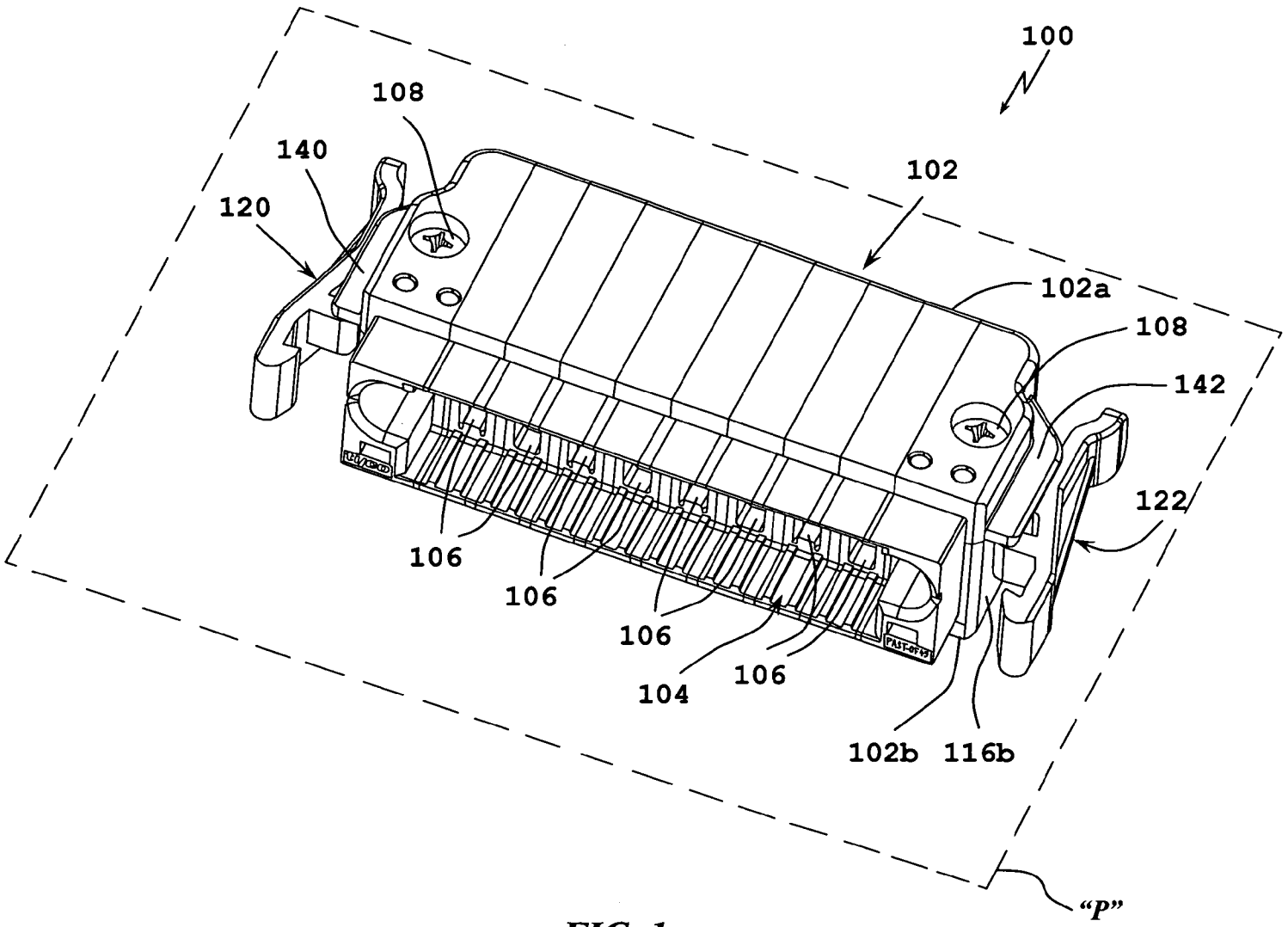
FIG. 1 is a perspective view of an electrical connector according to an embodiment of the present disclosure.
Figure 2:
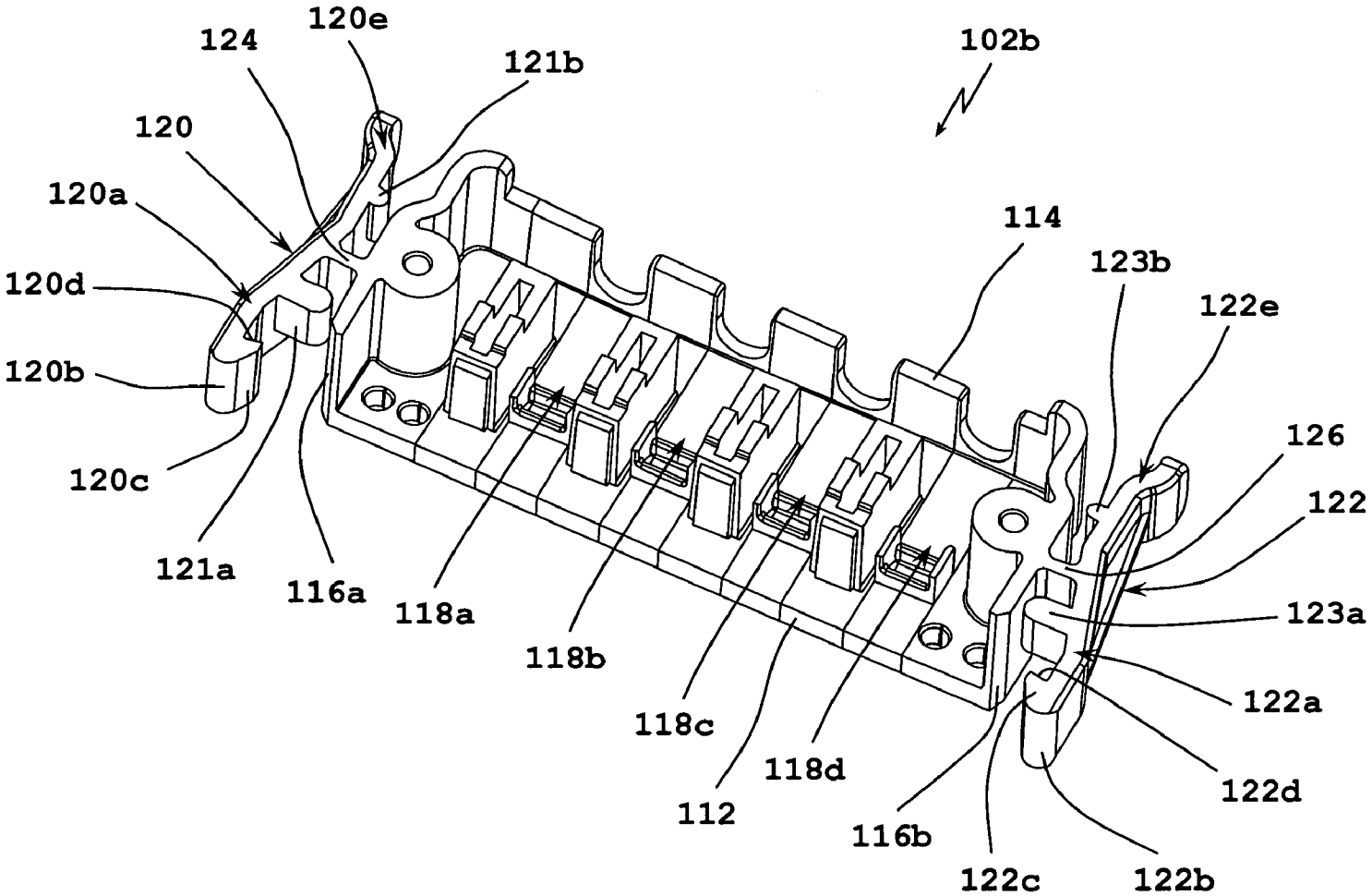
FIG. 2 is a top, perspective view of a bottom half-shell of the electrical connector of FIG. 1.

Embodiments of the presently disclosed electrical connector will now be described in detail with reference to the drawing figures wherein like reference numerals identify similar or identical elements. As used herein and as is traditional, the term "distal" refers to that portion which is furthest from the user while the term "proximal" refers to that portion which is closest to the user. In addition, terms such as "above", "below", "forward", "rearward", etc. refer to the orientation of the figures or the direction of components and are simply used for convenience of description.

Referring to FIGS. 1–11, an electrical connector, according to an embodiment of the present disclosure, is generally designated as 100. Connector 100 includes a housing 102 having a top half-shell 102*a* and a bottom half-shell 102*b*. As seen in FIG. 1, housing 102 includes a receiving recess 104 having a plurality of electrical contact channels 106 formed therein. Each contact channel 106 may include an electrical contact therein (not shown) for electrical connection with a complementary electrical contact of a connector receptacle (not shown). Contact channel 106 is particularly shaped to mate with a complementary element or structure of the connector receptacle.

Housing 102, including top half-shell 102*a* and/or bottom half-shell 102*b*, may be made from a dielectric material. Desirably, top half-shell 102*a* and bottom half-shell 102*b* are secured to one another by fastening means, such as screws 108, or other securing structures, such as, for example, clips, snap-fit engaging structure and the like.

Electrical connector 100, as described herein, is an eight position connector for use with an eight wire communications cable. However, it should be understood that the invention can also be applied to other connectors which are terminable to different numbers of wires.

As seen in FIGS. 1–6, bottom half-shell 102*b* of housing 102 includes a bottom wall 112, a rear wall 114 extending substantially orthogonally from bottom wall 112, and a pair of spaced apart side walls 116*a*, 116*b* extending substantially orthogonally from bottom wall 112. Bottom half-shell 102*b* includes a plurality of channels 118*a*–118*d* formed therein for accommodating electrical contacts and/or wire cables therein.

With continued reference to FIGS. 1–6, electrical connector 100 further includes a pair of latch arms 120, 122 integrally joined to side walls 116*a*, 116*b* of bottom half-shell 102*b* of housing 102 at respective flexible integral hinge joints 124, 126 located approximately midway along latch arms 120, 122. Each latch arm 120, 122 includes a respective forward portion 120*a*, 122*a* concluding in a free end 120*b*, 122*b*. Each free end 120*b*, 122*b* of latch arms 120, 122 includes a latching projection 120*c*, 122*c*, respectively, which extends towards a respective side wall 116*a*, 116*b* of bottom half-shell 102*b*. Each projection 120*c*, 122*c* defines a latching surface 120*d*, 122*d*. In use, latching surfaces 120*d*, 122*d* selectively engage corresponding complementary recesses (not shown) provided in or on the connector receptacle.

Each latch arm 120, 122 further includes a respective rearward portion 120*e*, 122*e* extending rearwardly from respective hinge joints 124, 126. Desirably, rearward portions 120*e*, 122*e* of latch arms 120, 122 are configured and adapted for gripping by a user.

Figure 3:
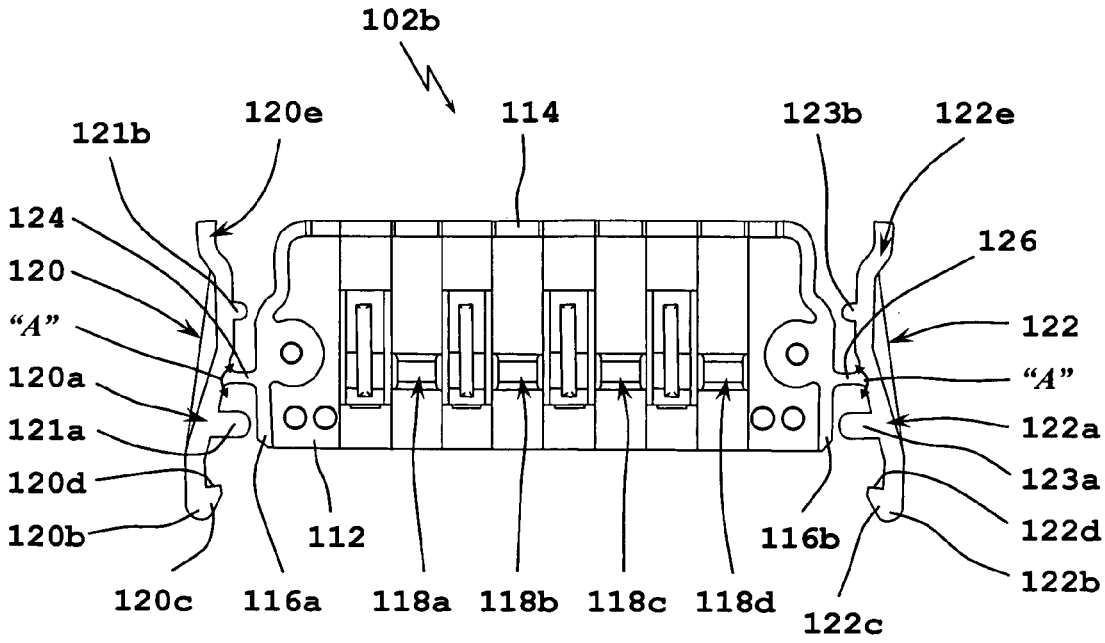
FIG. 3 is a top, plan view of the bottom half-shell of FIGS. 1 and 2.
Figure 4:
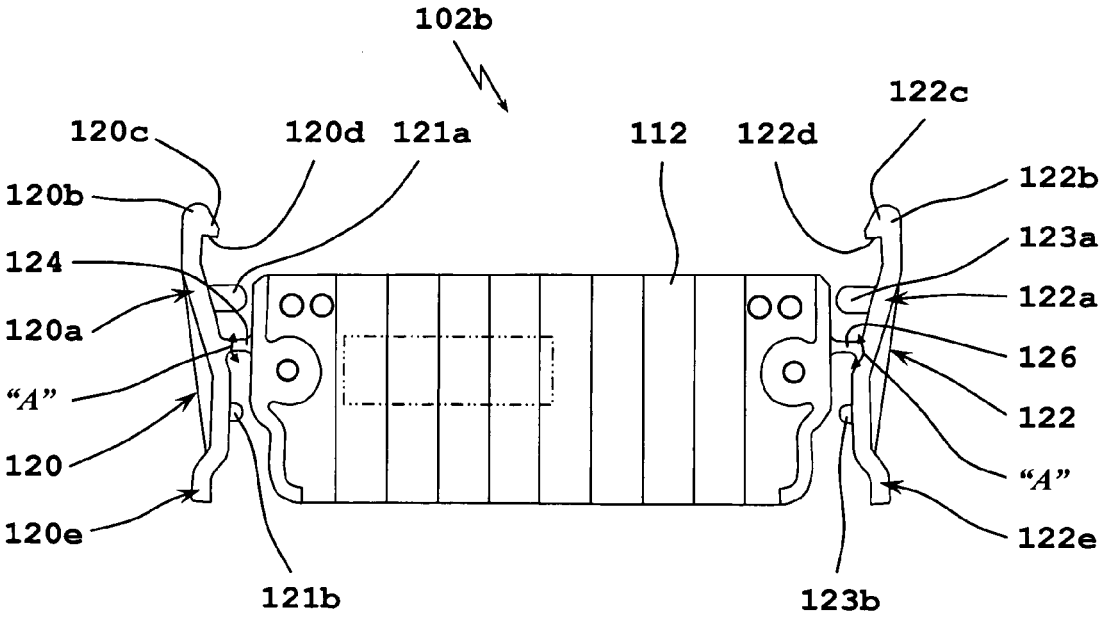
FIG. 4 is a bottom, plan view of the bottom half-shell of FIGS. 1–3.
Figure 6:
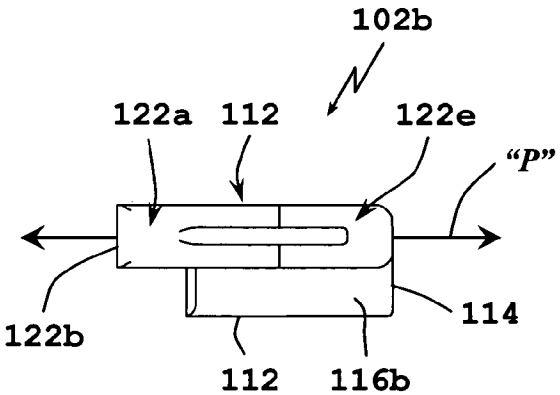
FIG. 6 is a side elevational view of the bottom half-shell of FIGS. 1–5.
Figure 5:
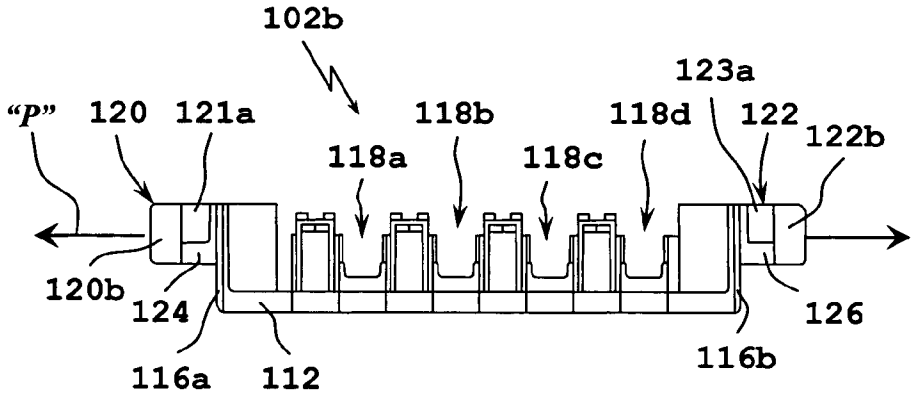
FIG. 5 is a front, elevational view of the bottom half-shell of FIGS. 1–4.
Figure 7:
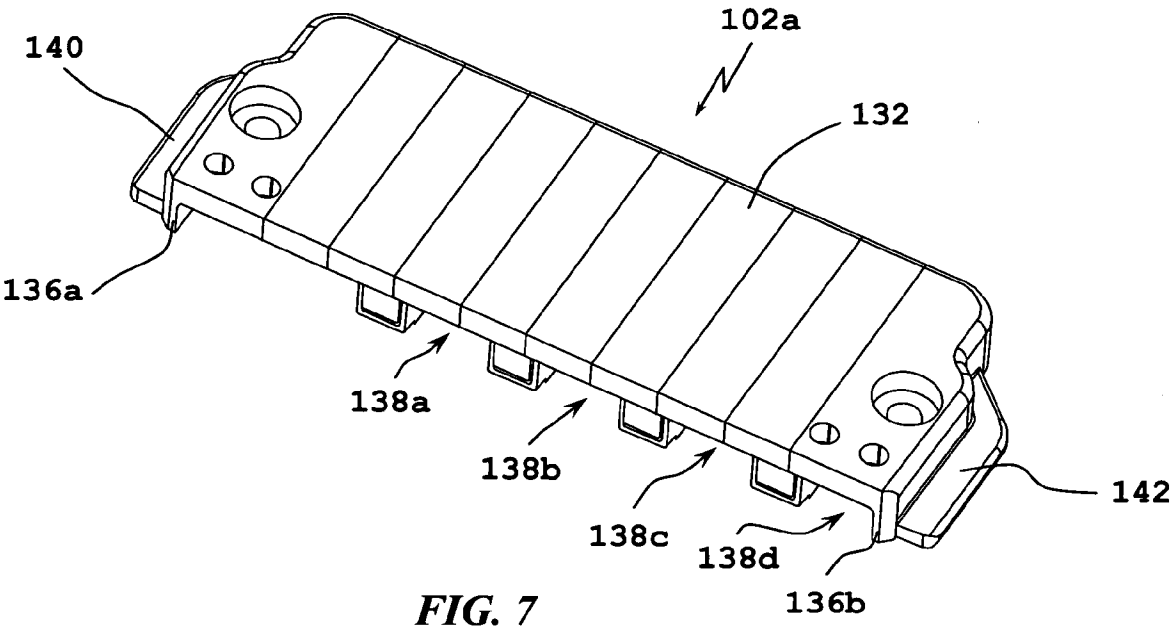
FIG. 7 is a top, perspective view of a top half-shell of the electrical connector of FIG. 1.
Figure 9:
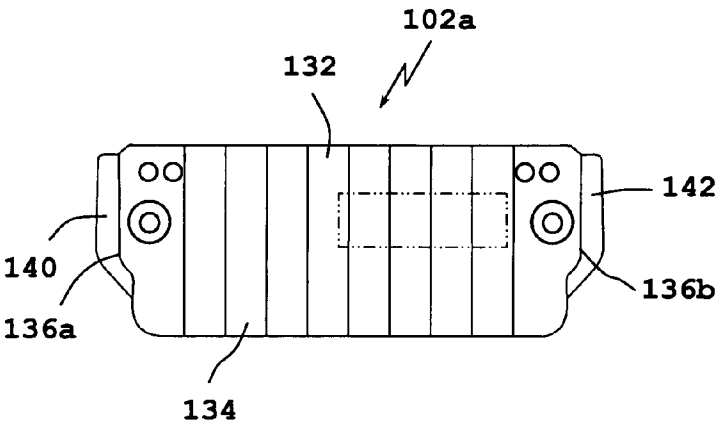
FIG. 9 is a top, plan view of the top half-shell of FIGS. 1, 7 and 8.
Figure 8:
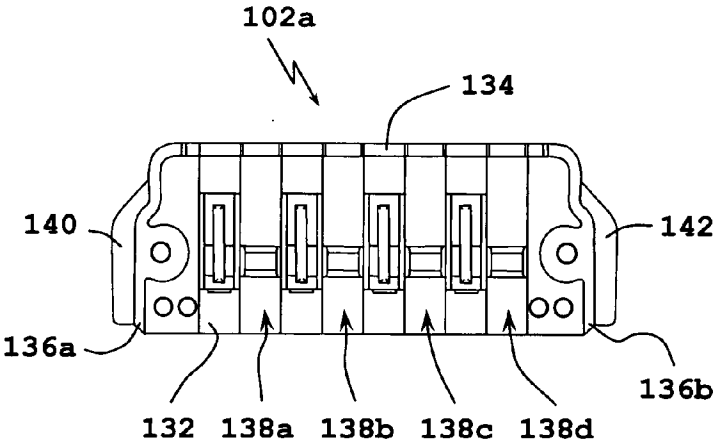
FIG. 8 is a bottom, plan view of the top half-shell of FIGS. 1 and 7.
Figure 11:
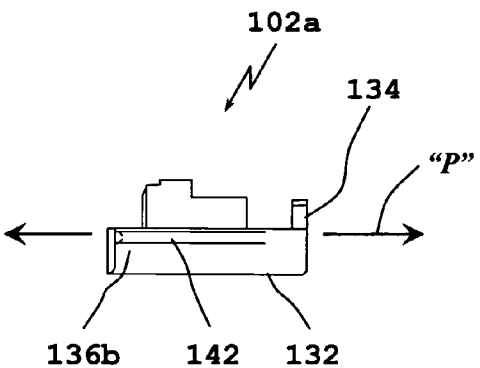
FIG. 11 is a side elevational view of the top half-shell of FIGS. 1 and 7–10.
Figure 10:
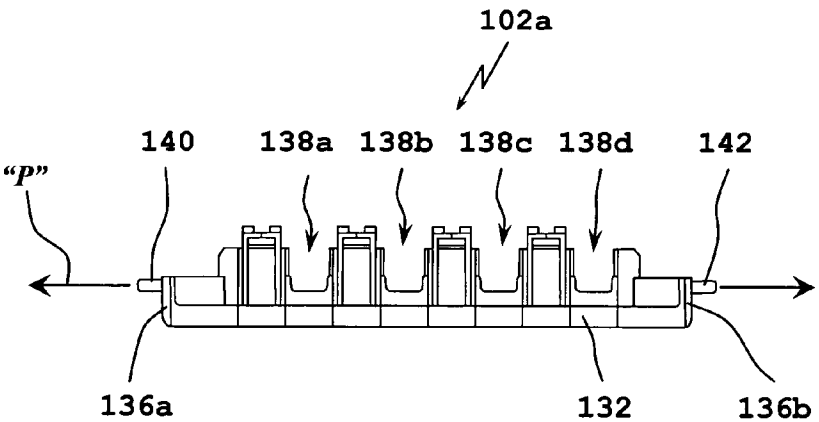
FIG. 10 is a front, elevational view of the top half-shell of FIGS. 1 and 7–9.

Each hinge joint 124, 126 is capable of enabling latch arm deflection in a plane "P" (see FIGS. 1, 5, 6, 10 and 11). Plane "P" is desirably co-planar to an upper or lower surface of housing 102 of electrical connector 100, or orthogonal to a front surface of housing 102 of electrical connector 100. In particular, each latch arm 120, 122 may be deflected at or about respective hinge joints 124, 126, so as to move in plane "P" in the direction of arrows "A", as seen in FIGS. 3 and 4.

Desirably, each latch arm 120, 122 includes a distal or first stop feature 121*a*, 123*a*, respectively, projecting from an inner surface of forward portion 120*a*, 122*a*, towards respective side walls 116*a*, 116*b* of bottom half-shell 102*b*. In use, as will be described in greater detail below, distal stop features 121*a*, 123*a* prevent excessive or over-flexure of forward portions 120*a*, 122*a* of latch arms 120, 122 toward side walls 116*a*, 116*b* of bottom half-shell 102*b*. In particular, if forward portions 120*a*, 122*a* of latch arms 120, 122 are deflected towards respective side walls 116*a*, 116*b* of bottom half-shell 102*b*, stop features 121*a*, 123*a* abut against respective side walls 116*a*, 116*b* of bottom half-shell 102*b* and prevent further flexure of forward portion 120*a*, 122*a* towards respective side walls 116*a*, 116*b* of bottom half-shell 102*b*.

Each latch arm 120, 122 further includes a proximal or second stop feature 121*b*, 123*b*, respectively, projecting from an inner surface of rearward portion 120*e*, 122*e*, towards respective side walls 116*a*, 116*b* of bottom half-shell 102*b*. In use, as will be described in greater detail below, proximal stop features 121*b*, 123*b* prevent excessive or over-flexure of rearward portions 120*e*, 122*e* of latch arms 120, 122 toward side walls 116*a*, 116*b* of bottom half-shell 102*b*. In particular, if rearward portions 120*e*, 122*e* of latch arms 120, 122 are deflected towards respective side walls 116*a*, 116*b* of bottom half-shell 102*b*, stop features 121*b*, 123*b* abut against respective side walls 116*a*, 116*b* of bottom half-shell 102*b* and prevent further flexure of rearward portion 120*e*, 122*e* towards respective side walls 116*a*, 116*b* of bottom half-shell 102*b*.

During mating of electrical connector 100 to a complementary connector receptacle, forward portions 120*a*, 122*a* of latch arms 120, 122 are deflected outwardly (i.e., away from side walls 116*a*, 116*b* of bottom half-shell 102*b*) near respective free ends 120*b*, 122*b* as latching projections 120*c*, 122*c* ride over mating projections provided on the connector receptacle (not shown). As forward portions 120*a*, 122*a* of latch arms 120, 122 are deflected outwardly, rearward portions 120*e*, 122*e* of latch arms 120, 122 deflect inwardly due to the pivoting or flexure about hinge joints 124, 126. Over deflection or over flexure of rearward portions 120*e*, 122*e* of latch arms 120, 122 is prevented when proximal stop features 121*b*, 123*b* of latch arms 120, 122 abut against and/or otherwise contact side walls 116*a*, 116*b* of bottom half-shell 102*b*. Upon complete and proper mating, latching surfaces 120*d*, 122*d* of latch arms 120, 122 latch behind the respective projections provided on the connector receptacle (not shown).

Turning now to FIGS. 1 and 7–10, top half-shell 102*a* of housing 102 includes a top wall 132, a rear wall 134 extending substantially orthogonally from top wall 132, and a pair of spaced apart side walls 136*a*, 136*b* extending substantially orthogonally from top wall 132. Top half-shell 102*a* includes a plurality of channels 138*a*–138*d* formed therein for accommodating electrical contacts and/or wire cables therein. Channels 138*a*–138*d* of top half-shell 102*a* correspond to and register with channels 118*a*–118*d* of bottom half-shell 102*b*.

With continued reference to FIGS. 1 and 7–11, top half-shell 102*a* includes a latch guard, wall, ledge or flange 140, 142 projecting from each side wall 136*a*, 136*b* thereof. Desirably, each latch guard 140, 142 extends from a front edge of side wall 136*a*, 136*b* proximally along substantially an entire length of side wall 136*a*, 136*b*. More desirably, latch guards 140, 142 substantially overlie respective latch arms 120, 122 of bottom half-shell 102*b* when top half-shell 102*a* is connected to bottom half-shell 102*b*.

Figure 12:
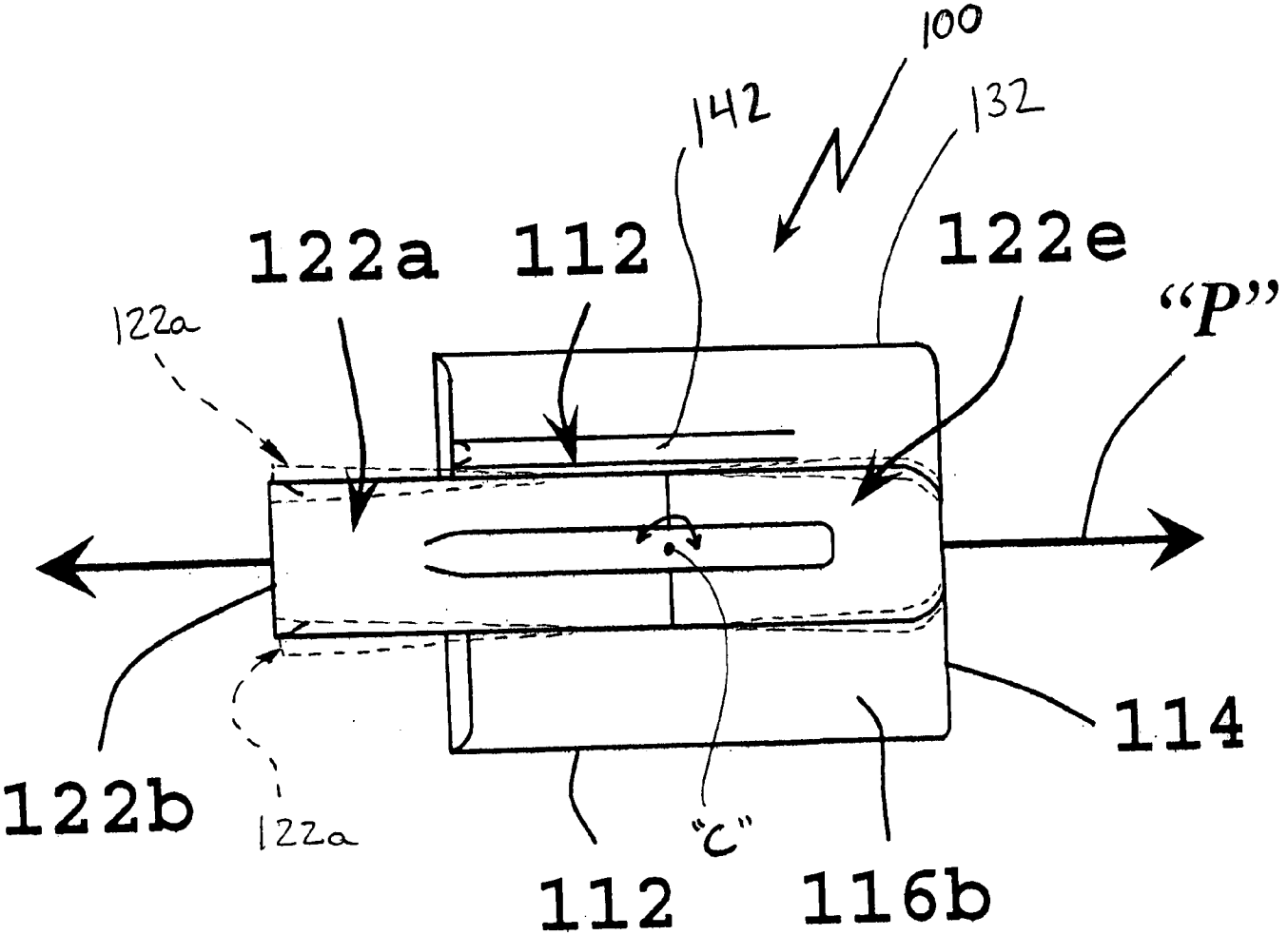
FIG. 12 is a side elevational view of the electrical connector of FIG. 1, illustrating the blocking feature of the latch guards.

As seen in FIGS. 1 and 12, at least distal stop features 121*a*, 123*a* of latch arms 120, 122 extend at least partially beneath respective latch guards 140, 142. Additionally, at least a portion of rearward portions 120*e*, 122*e* of latch arms 120, 122 are disposed beneath latch guards 140, 142. Accordingly, in use, excessive twisting of latch arms 120, 122, about hinge joints 124, 126 (i.e., in a direction orthogonal to plane "P" of the latch arm 120, 122 and orthogonal to a longitudinal axis of the latch arms 120, 122 or about rotational axis "C") is prevented by latch guards 140, 142. The abutment of latch arm 122, either at a forward end of latch guard 142 or at a rearward end of latch guard 142, is shown in phantom in FIG. 12.

In particular, if, during manipulation of electrical connector 100 or during mating of electrical connector 100 to a connector receptacle, either latch arm 120, 122 should twist about hinge joints 124, 126 (i.e., forward portions 120*a*, 122*a* of latch arms 120, 122 deflect in a direction transverse to the pivot plane of the latch arms 120, 122) at least a portion of the latch arm 120, 122 (e.g., stop features 121*a*, 123*a*, 121*b*, 123*b*) will abut against a respective latch guard 140, 142 and prevent or inhibit any further twisting of latch arm 120, 122 about hinge joints 124, 126 in a direction transverse to the pivot plane.

Provision of latch guards 140, 142 on electrical connector 100 reduce the risk of damage to latch arms 120, 122 as a result of excessive twisting of latch arms 120, 122 as described above.

Desirably, housing 102 and latch arms 120, 122 are fabricated from dielectric materials, including and not limited to plastic and the like.

It is to be understood that the foregoing description s merely a disclosure of particular embodiments and is no way intended to limit the scope of the invention. Other possible modifications will be apparent to those skilled in the art and all modifications are to be defined by the following claims.

What is claimed is:

1. An electrical connector for mating with a complementary connector receptacle, the electrical connector comprising:

a housing configured and adapted for selective matable connection with a corresponding complementary connector receptacle;

a pair of latch arms provided on opposite sides of the housing, each latch arm includes:

latching projections at a forward end of the latch arm which are configured and adapted for selective engagement with corresponding latching means provided on the connector receptacle; and a hinge joint spaced a selected distance rearwardly from the forward end of the latch arm and spaced a selected distance forwardly from a rear end of the latch arm, the hinge joint joining the latch arm to a respective side of the housing; and a pair of latch guards extending from the sides of the housing and overlying at least a portion of a respective latch arm, wherein each latch guard extends distally and proximally of the hinge joint, wherein as a latch arm is twisted about the hinge joint, at least a portion of the latch arm abuts against the respective latch guard and additional twisting of the latch arm about the hinge joint is prevented.

2. The electrical connector according to claim 1, wherein each latch arm includes a first stop feature extending therefrom at a location between the latching projection and the hinge joint, wherein the first stop feature extends towards the housing.

3. The electrical connector according to claim 2, wherein upon twisting of the latch arm about the hinge joint, the first stop feature is engagable with the respective latch guard to stop twisting of the latch arm.

4. The electrical connector according to claim 3, wherein each latch arm includes a rearward portion extending rearwardly from the respective hinge joint.

5. The electrical connector according to claim 4, wherein each latch arm includes a second stop feature extending therefrom at a location rearward of the hinge joint, wherein the second stop feature extends towards the housing.

6. The electrical connector according to claim 5, wherein upon twisting of the latch arm about the hinge joint, the second stop feature is engageable with the respective latch guard to stop twisting of the latch arm.

7. The electrical connector according to claim 6, wherein each latch arm is deflectable about the hinge joint.

8. The electrical connector according to claim 7, wherein flexure of the forward end of the latch arm toward the housing is stopped by the first stop feature.

9. The electrical connector according to claim 8, wherein flexure of the rearward end of the latch arm toward the housing is stopped by the second stop feature.

10. The electrical connector according to claim 9, wherein the housing and the latch arms are fabricated from a dielectric material.

11. In an electrical connector for selective mating with a complementary connector receptacle, wherein the electrical connector includes a housing, a pair of latch arms hingedly connected to and extending from opposite sides of the housing at a hinge joint, wherein each latch arm extends distally and proximally of the hinge joint, the improvement comprising:

a pair of latch guards extending from opposite sides of the housing, wherein each latch guard overlies at least a portion of a respective latch arm, wherein the latch guards stop twisting of the latch arms about the hinge joint in a direction transverse to a longitudinal axis of the latch arms, and wherein the latch guards extend distally and proximally of the hinge joint.

12. The electrical connector according to claim 11, wherein each latch arm includes a latching projection at a forward end thereof for selectively engaging a corresponding latching means provided on the connector receptacle.

13. The electrical connector according to claim 12, wherein the hinge joint is spaced a selected distance rearwardly from the forward end of the latch arm.

14. The electrical connector according to claim 13, wherein each latch guard extends distally and proximally of the hinge joint.

15. The electrical connector according to claim 14, wherein the latch guards stop twisting of the latch arms about an axis transverse to a pivot axis of the hinge joint.

16. The electrical connector according to claim 15, wherein each latch arm includes a first stop feature extending therefrom at a location between the latching projection and the hinge joint, wherein the first stop feature extends towards the housing.

17. The electrical connector according to claim 16, wherein upon twisting of the latch arm about the hinge joint, the first stop feature is engagable with the respective latch guard to stop twisting of the latch arm.

18. The electrical connector according to claim 17, wherein each latch arm includes a rearward portion extending rearwardly from the respective hinge joint.

19. The electrical connector according to claim 18, wherein each latch arm includes a second stop feature extending therefrom at a location rearward of the hinge joint, wherein the second stop feature extends towards the housing.

20. The electrical connector according to claim 19, wherein upon twisting of the latch arm about the hinge joint, the second stop feature is engageable with the respective latch guard to stop twisting of the latch arm.

* * * * *